US008336713B2

(12) United States Patent
Poitevin

(10) Patent No.: US 8,336,713 B2
(45) Date of Patent: Dec. 25, 2012

(54) PACKAGING CONTAINER, BLANK AND METHOD OF FORMING A PACKAGING CONTAINER

(75) Inventor: Patrick Jules Joseph Poitevin, Birmingham (GB)

(73) Assignee: Cadbury UK Limited (GB)

( * ) Notice: Subject to any disclaimer, the term of this patent is extended or adjusted under 35 U.S.C. 154(b) by 0 days.

(21) Appl. No.: 13/060,727

(22) PCT Filed: Aug. 21, 2009

(86) PCT No.: PCT/GB2009/002064

§ 371 (c)(1), (2), (4) Date: Apr. 15, 2011

(87) PCT Pub. No.: WO2010/023439

PCT Pub. Date: Mar. 4, 2010

(65) Prior Publication Data

US 2011/0186476 A1 Aug. 4, 2011

(30) Foreign Application Priority Data

Aug. 28, 2008 (GB) ..... 0815593.9

(51) Int. Cl.
*B65D 73/00* (2006.01)
*B65D 85/00* (2006.01)
*B65D 5/48* (2006.01)

(52) U.S. Cl. ..... 206/485; 206/526; 229/120.15

(58) Field of Classification Search ..... 206/485, 206/526, 564, 736, 756, 763–765; 229/120.15, 229/120.18; 53/452, 456
See application file for complete search history.

(56) References Cited

U.S. PATENT DOCUMENTS

| | | | | |
|---|---|---|---|---|
| 814,069 | A * | 3/1906 | Naylor | 229/120.15 |
| 3,286,830 | A * | 11/1966 | Robb, Jr. | 206/526 |
| 3,696,940 | A | 10/1972 | Hoffman et al. | |
| 3,968,924 | A | 7/1976 | Tyrseck | |
| 4,416,412 | A | 11/1983 | Wischusen, III | |
| 4,432,454 | A * | 2/1984 | Bloom | 206/425 |
| 4,830,272 | A * | 5/1989 | Wear et al. | 229/120.15 |
| 5,555,982 | A * | 9/1996 | Kuhn et al. | 206/526 |
| 6,402,021 | B1 | 6/2002 | Heathcock | |
| 7,159,721 | B2 * | 1/2007 | Martin, Jr. | 206/765 |
| 2003/0024848 | A1 * | 2/2003 | Oycke | 206/526 |

FOREIGN PATENT DOCUMENTS

DE 298 17 435 U1 11/1998

(Continued)

OTHER PUBLICATIONS

PCT Search Report, International Application No. PCT/GB2009/002064, Mar. 22, 2010.

*Primary Examiner* — Bryon Gehman
(74) *Attorney, Agent, or Firm* — Hoffmann & Baron, LLP

(57) ABSTRACT

A packaging container (10; 100) for transporting and displaying a plurality of individually packaged products (25; 25') is formed from a blank and comprises at least a base (14; 14') and side walls (20, 22; 20', 22'). Tabs (60; 102, 104) are provided along opposing side walls and project into the interior volume for contact with products (25; 25') to hold them in an upright or display position. Each tab (60; 102, 104) comprises a portion of the side wall which is bent inwardly out of the plane of the side wall about a fold line (62; 62') leaving an aperture in the side wall. Prior to bending, each tab is surrounded about its free edge(s) by a cut-out (63, FIG. 4) such that the surface area of the tab is less than the surface area of the aperture.

25 Claims, 5 Drawing Sheets

FOREIGN PATENT DOCUMENTS

| | | | |
|---|---|---|---|
| DE | 20 2005 015804 | U1 | 2/2007 |
| EP | 0 940 345 | A1 | 9/1999 |
| FR | 2 843 733 | A1 | 2/2004 |
| FR | 2 870 523 | A1 | 11/2005 |
| GB | 2 240 321 | A | 7/1991 |
| WO | 02/28727 | A1 | 4/2002 |

* cited by examiner

PACKAGING CONTAINER, BLANK AND METHOD OF FORMING A PACKAGING CONTAINER

CROSS-REFERENCE TO RELATED APPLICATIONS

This application is the National Stage of International Application No. PCT/GB2009/002064, which designates the U.S., filed Aug. 21, 2009, which claims the benefit of GB 0815593.9, filed Aug. 28, 2008, the contents of which are incorporated by reference herein.

TECHNICAL FIELD OF THE INVENTION

The present invention relates to a packaging container for transporting and/or displaying a plurality of packaged products. The invention also relates to a blank for forming the packaging container and to a method of forming the container.

BACKGROUND TO THE INVENTION

It is known to use packaging containers such as paperboard or cardboard boxes, cartons and trays for storing and transporting individually packaged products. A number of individually packaged products are placed in the packaging container, which is generally closed by means of an integral folded top closure or by means of a separate, removable lid for transport to a retail outlet. At the retail outlet the container package is opened to display the products and placed on a shelf without having to remove the individual products from the container.

Opening the packaging container may involve removal of the lid or, where the packaging container is closed by means of an integral folded top closure, at least a portion of the top and often part of a front wall of the container may be removed by tearing along a line of weakness. A wide range of products are stored and transported in this way, including: confectionery, snack foods, cereals, household goods, cosmetics and other personal care products, for example.

In order to display the products, it is desirable that they are positioned in the container in a generally upright condition. However, products which have a relatively small base are generally unstable in the packaging container and have a tendency to fall over or to slip down once a number of the products have been removed from the container. There have been attempts to solve this problem by modifying the base of the packaging container to support the individually packaged products or by coating the base with an anti-slip material. GB 2 240 321 A for example discloses a cardboard tray having a series of slits across the base of the tray connected by creases extending along the length of the tray. This gives the base a saw-tooth configuration along its length to provide support for products.

In an alternative arrangement, EP 0 940 345 A1 discloses an open top container having a number of flaps or tabs formed in opposing side wall regions. The flaps have prongs and are connected with the side wall along their upper edges by means of a fold line. The flaps align with in corresponding openings formed in side wall regions of a lid for the container. When the lid is lifted, the prongs engage in the apertures and are hinged upwardly to project into the tray to provide product dividers. The arrangement disclosed is complex to produce and assemble which results in increased manufacturing costs. Furthermore, the flaps do act to support the products in the container until the lid is removed.

There is a need, therefore, for an alternative packaging container which provides support for individually packaged products which overcomes, or at least mitigates one or more of the drawbacks of the known arrangements.

There is also a need for an alternative packaging container which provides support for individually packaged products which can be produced from a single blank of material.

SUMMARY OF THE INVENTION

In accordance with a first aspect of the invention, there is provided a packaging container for transporting and/or displaying a plurality of individually packaged products, the container comprising at least a base and side walls defining an interior volume for holding the products, in which at least one side wall has one or more tabs, the tab(s) projecting into the interior volume for contact with products in the container, each tab comprising a portion of the at least one side wall which is bent inwardly out of the plane of the side wall about a fold line leaving an aperture in the side wall, and, prior to bending, each tab being surrounded about its free edge(s) by a cut-out in the side wall such that the surface area of the tab is less than the surface area of the aperture.

One or more tabs may be provided on each of two opposing side walls.

A side wall may have a plurality of tabs spaced along its length.

A side wall may be joined to the base along an edge and the fold line may be at an acute angle with respect to at least part of the edge. The acute angle may be less than about 75°.

It should be noted that the term "about" is used herein in relation to angular measurements to include a range of +/−10 degrees from the stated angle.

A side wall may be joined to the base along an edge and the fold line may be substantially parallel to at least part of the edge.

There may be three or more separate tabs on each of two opposing side walls, each tab being connected with the reminder of its respective sidewall by means of a fold line defining a lower edge of the tab.

The tabs may be bent about their respective fold lines through an angle of about 90° or more.

The tabs may be resiliently biased to a rest position in which the distance between the free ends of opposed pairs of tabs and/or between the free end of each tab and the inner surface of the opposing side wall is less than the width of the individually products to be contained.

The container may have front and rear walls and an integral top closure. In which case, the container may have one or more lines of weakness arranged such that at least a portion of the top closure can be removed by tearing along the one or more lines of weakness.

The one or more lines of weakness may be arranged such that the whole of the top closure and at least a portion of the front wall can be removed by tearing along the one or more lines of weakness.

The one or more lines of weakness may be arranged so that a portion of the rear wall can be removed by tearing along the one or more lines of weakness.

In one embodiment, the packaging container is formed from a single, unitary blank of material.

In accordance with a second aspect of the invention, there is provided a combination of a packaging container in accordance with the first aspect and a plurality of individually packaged products within the interior volume of the container, the tab(s) contacting end regions of the products.

The tab(s) may be resiliently biased towards a rest position in which the distance between the free ends of opposed pairs of tabs and/or between the free end of each tab and the inner surface of the opposing side wall is less than the width of the individually packaged products, the arrangement being such that tab(s) is/are bent beyond the rest position against the bias force by the products when introduced into the internal volume.

The products may be confectionery products such as chocolate bars.

In accordance with a third aspect of the invention, there is provided a method of forming a packaging container for transporting and/or displaying a plurality of individually packaged products, the method comprising:

a. providing a container comprising at least a base and side walls defining an interior volume for holding the products;

b. providing one or more tab(s) on at least one side wall, the tab(s) being connected to the remainder of the side wall by a fold line and the free edge(s) of the tabs may be spaced from the remainder of the side wall by a cut-out;

c. bending the tab(s) about their respective fold lines so that they project into the interior volume for contact with products in the container.

One or more tabs may be provided on opposing side walls.

A side wall may have a plurality of tabs spaced along its length.

A side wall may be joined to the base along an edge and the fold line may be at an acute angle with respect to at least part of the edge. The acute angle may be less than about 75°.

A side wall may be joined to the base along an edge and the fold line may be substantially parallel to at least part of the edge.

The container may have three or more separate tabs on each of two opposing side walls, each tab being connected with the reminder of its respective side wall by means of a fold line defining a lower edge of the tab.

The tab(s) may be bent through an angle of about 90° or more from an initial position in which they are substantially coplanar with their respective side wall.

In one embodiment, the method comprises introducing a plurality of individually packaged products into the interior volume after the tab(s) has/have been bent through an angle of about 90° or more. In an alternative embodiment, the method comprises bending the tab(s) through an angle of less than about 90°, subsequently introducing a plurality of individually packaged products into the interior volume so that the products contact the tab(s) as they are inserted into the interior volume and further bend the tab(s) through an angle of more than about 90°.

The method may comprise forming the container from a single, unitary blank of material.

In accordance with a fourth aspect of the invention, there is provided a blank for forming a packaging container in accordance with the first aspect or for use in the method of the second aspect, the blank comprising a single unitary sheet of material having fold lines which define panel portions which constitute the side walls of the container when it is formed, in which one or more tabs are provided on at least one the side wall panel portions, the tab(s) being connected with the remainder of their respective side wall panel portion(s) by means of a fold line about which the tab(s) can be bent out of the plane of their respective panel portion, the free edge(s) of the tabs being spaced from the remainder of their respective panel portion by means of a cut-out.

One or more tabs may be provided on panel portions which define opposing side walls of the container when it is formed.

At least one side wall panel portion may have a plurality of tabs spaced along its length.

Each tab may be formed by means of a cut line in its respective side wall panel portion. Each tab may be formed by means of spaced cut lines to define the cut-out. Each tab may be is semi-circular in shape. The semi-circular tab may be formed by means of an arcuate cut-out.

In one embodiment, the blank comprises four main panels arranged in-line with adjacent main panels being separated by a transverse fold line, each main panel being divided into three panel portions by means of spaced longitudinal fold lines; a middle one of the panel portions being configured to form a wall of the container when it is formed, a first outer one of the panel portions comprising a flap for forming the base of the container when it is formed and the other of the outer panel portions comprising a flap for forming a top closure of the container when it is formed.

The blank may have one of more lines of weakness configured to enable at least the flaps which form the top closure to be removed from the completed container by tearing along the lines of weakness.

A middle panel portion of one of the main panel portions may constitute a front wall of the completed container, and the one or more lines of weakness may extend into the front wall panel portion and be configured such that a portion of the front wall of the completed container can be removed by tearing along the one or more lines of weakness.

BRIEF DESCRIPTION OF THE DRAWINGS

An embodiment of the invention will now be described, by way of example only, with reference to the accompanying drawings, in which.

DETAILED DESCRIPTION OF PREFERRED EMBODIMENTS

Figure 1:
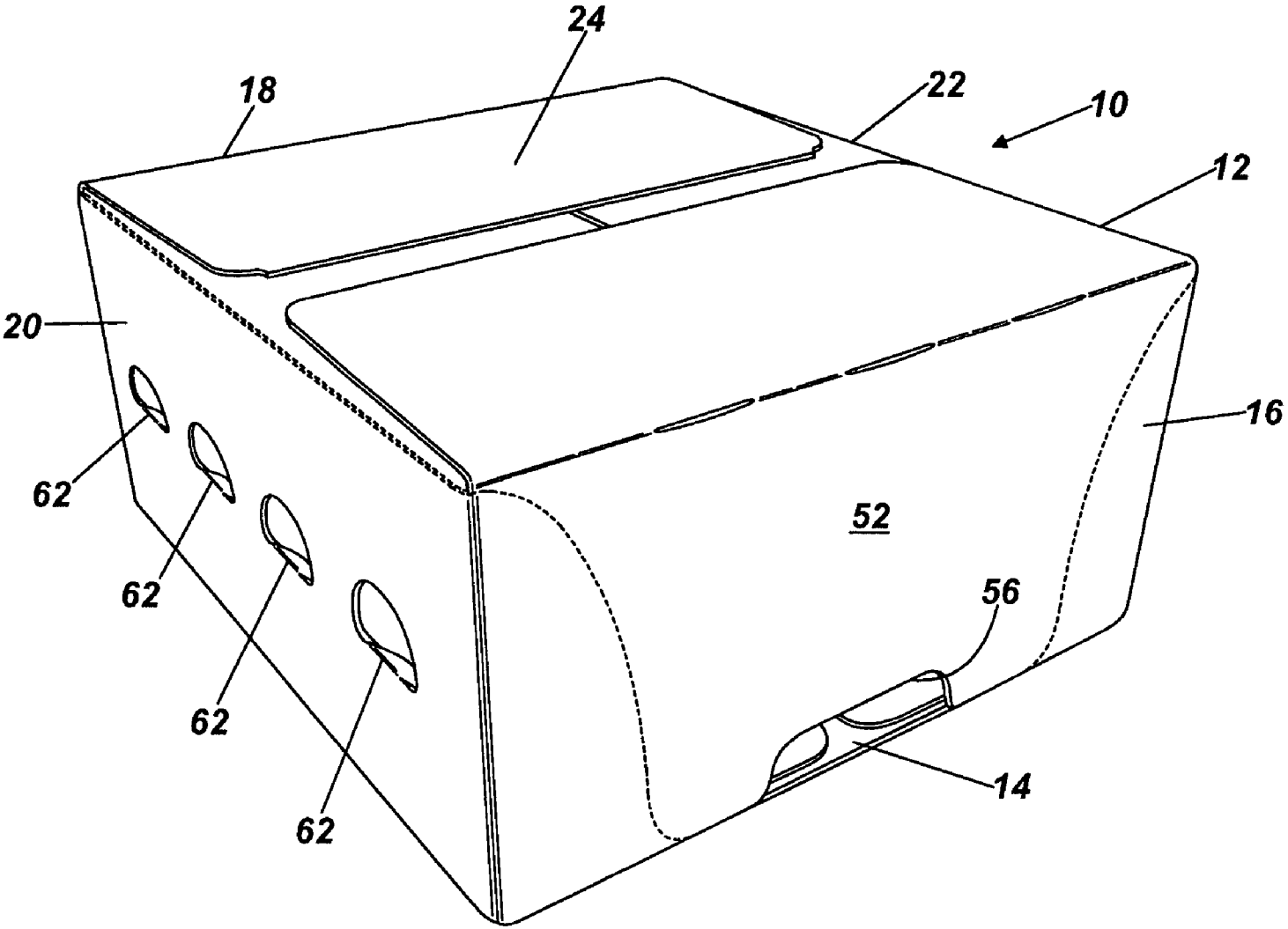
FIG. 1 is a perspective view of a packaging container in accordance with the invention.

An embodiment of a packaging container 10 in accordance with the invention is in the form of a box 12 having a base 14, a front wall 16, a rear wall 18, two side walls 20, 22 and a top 24 which together define an interior volume for holding a plurality of individually packaged products 25.

In the present embodiment, the packaging container 10 is formed from a single blank 26 of material. However, it is possible to produce packaging containers in accordance with the invention from two or more separate blanks of material or by any other suitable method. The packaging container can be made of any suitable material, such as cardboard, paperboard or the like.

The blank 26 comprises four main panels 28, 30, 32, 34, arranged in a line and separated by lateral fold lines 36, 38, 40. A tab 42 is attached to a first main panel 28 by a further lateral fold line 44. Each of the main panels is divided into three sections by means of a pair of spaced, parallel longitudinal fold lines 46, 48. An upper section 28*a*, 30*a*, 32*a*, 34*a*, of each main panel is a closure flap for forming the top of the packaging container 10 whilst a lower section 28*b*, 30*b*, 32*b*, 34*b* of each main panel is a closure flap for forming the base of the container. The central sections 28*c*, 32*c* of the first and third main panels 28, 30 each form a side wall of the container, whilst the central sections 30*c*, 34*c* of the second and fourth main panels 30, 34 form the front 16 and rear 18 walls of the container respectively.

One or more lines of perforations 50 is/are formed in the blank 26 to enable a portion 52 of the front wall 16, the top 24 and a portion 54 of the rear wall of the container to be removed when the container is opened. An opening 56 is provided at the lower edge of the middle section 30*c* of the second main panel 30. The opening 56 enables a user to grasp the portion 52 of the front wall 16 in order to open the container 10 by tearing along the line(s) of perforations. A further opening 58 is provided in the middle section 34*c* of the fourth main panel 34. The further opening is positioned at the lower edge of the portion 54 of the rear wall 18 that is removed when the packaging container is opened and can also be used to assist in the opening process.

A plurality of tabs 60 are spaced along the length of the middle portions 28*c*, 32*c* of the first and second main panels 28, 32. The tabs 60 are formed in the panel portions 28*c*, 32*c* which form the side walls of the container by means of cut lines 61 and in the present embodiment are semi-circular in shape. Each tab 60 is connected with the remainder of the panel portion by means of a lower fold line 62 that extends substantially parallel to the fold line 48 that separates the side wall panel portion 28*c*, 32*c* from the flaps 28*b*, 32*b* which form the base, such that the fold lines extend substantially horizontally when the packaging container 10 is fully formed and positioned upright as shown in FIG. 1.

The terms "substantially parallel" and "substantially horizontal" are to be understood as including a range of +/−10 degrees from the parallel or horizontal as the case may be.

Figure 4:
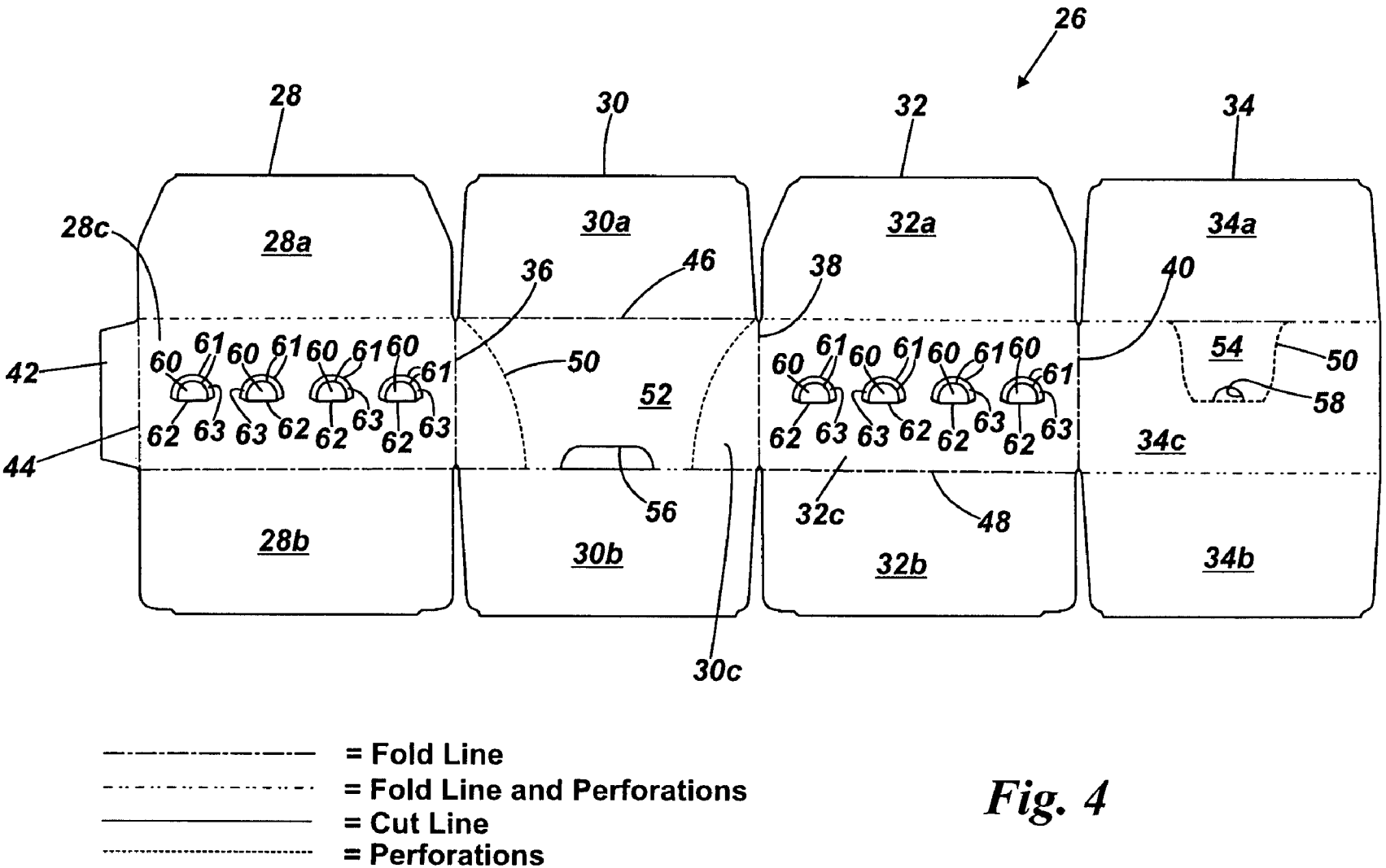
FIG. 4 is a plan view of a blank for forming the packaging container of FIG. 1.

For the avoidance of doubt, terms such as "upper" and "lower" refer to packaging container and the blank when positioned upright as shown in FIGS. 1 and 4 with the top uppermost. It will be appreciated that the packaging container 10 could be used in other orientations and in particular that the blank 26 may be held in a different orientation during construction of the container and the terms should be construed accordingly.

It will be noted that the free edges of the tabs 60 are spaced from the remainder of their respective side wall panel portion 28*c*, 32*c* by a cut-out 63 so that the tabs 60 have a smaller surface area than the apertures 63 in the side wall panel portion from which they are pressed. This makes it easier for the tabs 60 to be bent out of the side wall panel portions 28*c*, 33*c* as will be described later. The cut-out may defined by spaced cut lines 61.

To form the blank 26 into the container 10, the blank 26 is folded along the lateral fold lines 36-40 so that the main panels 28-34 form a rectangular enclosure. The tab 42 is then secured to the inner surface of the fourth main panel 34 to hold the main panels in position. The tab 42 may be secured using a suitable adhesive.

The base 14 of the packaging container 10 is produced by folding the lower flaps 28*b*, 30*b*, 32*b*, 40*b* inwardly and securing them in position using adhesive. In the present embodiment, the flaps 28*b*, 32*b* on the first and third main panels, which form the side walls of the container, are folded first and the flaps 30*b*, 34*b* are folded after and secured to the flaps 28*b*, 30*b*. It will be appreciated, however, that the flaps 28*b*, 30*b*, 32*b*, 34*b* could be folded in a different order.

With the walls 16, 18, 20, 22 and base 14 formed, the container defines an internal volume into which the individually packaged products can be introduced. At this stage, or earlier in the process, the tabs 60 are bent about their fold lines 62 so as to project into the interior volume. As can be seen best in FIG. 3, the tabs 60 are bent about the fold line 62 by about 90° or more from an initial position in which they are substantially coplanar with the side wall. When the tabs 60 are bent the material at the fold lines 62 forms a live hinge which tends to bias the tabs to a rest position in which the free ends 64 of the tabs are spaced from their respective side walls. In the present embodiment, the tabs 60 in each side wall are aligned with the tabs 60 in the opposing side wall and are configured so that when the tabs 60 are in their rest positions, the distance between the free ends of each pair of opposing tabs 60 is less than the width of the products 25.

When the products are introduced into the container 10, they contact the tabs 60 and bend the tabs further beyond the rest position towards the inner surface of their respective side walls against the bias force. As a result, the tabs 60 are resiliently biased into contact with the ends of the products 25. This helps to hold the products securely within the container 10 protecting them during transit as they are less likely to become damaged due to excessive movement within the packaging container.

The tabs 60 may be bent so that they take up the rest position as part of the process of assembling the packaging container 10 prior to insertion of the packaged products 25. Alternatively, the tabs 60 may only be partially bent so as to project into the container by a sufficient distance that when the products 25 are inserted they catch the tabs 60 and bend them up to and beyond the rest position. Because the tabs 60 are smaller than the apertures in the side wall, it is easier for the products to engage the edges of the tabs to bend the tabs up to and beyond the rest position as the products are inserted.

Although it is expected that the tabs 60 in the side walls will be arranged in opposing pairs as in the present embodiment, it is possible that the tabs 60 in one side wall are off-set from the tabs 60 in the other side wall. In this case, the packaging container 10 will be configured so that the distance between the free end of each tab 60 and the inner surface of the opposing side wall is less than the width of the product when the tabs 10 are in the rest position.

Once the products 25 have been inserted into the packaging container, the top 24 is closed by folding the upper flaps 28*a*, 30*a*, 32*a*, 34*a* and securing them in position using adhesive. As with the base, in the present embodiment the flaps 28*a*, 32*a* associated with the side walls 20, 22 are folded first and the flaps 30*a*, 34*a* associated with the front and rear walls 16, 18 are folded afterwards and secured to the flaps 28*a*, 30*a* using an adhesive. The upper flaps may be folded in a different order.

Any suitable adhesive can be used to secure the tab 42 and the flaps which form the base and top. The adhesive may be a heat and/or pressure sensitive adhesive. The adhesive may be pre-applied to the blank or it may be applied as part of the process of forming the container.

The completed and filled packaging container 10 can be transported to a retail outlet or other destination. At the retail outlet or destination the container is opened by tearing along the line of perforations 50 to remove the top and the portions 52, 54 of the front and rear walls. The packaging container 10 can then be placed on a shelf where the products 25 can be seen by customers who can remove them from the container as required.

When the packaging container is full, the products 25 tend to remain in the upright position because they are constrained between the remaining portions of the front and rear walls and the side walls. As the products 25 are removed, the tabs 60 are sequentially uncovered from the front to the rear. As each pair of opposing tabs 60 is uncovered, the resilience of the material at the fold line 62 biases them outwardly towards the rest position, where they act as a stop to prevent the remaining products in the container from toppling over or from sliding down. This is shown best in FIG. 3.

In the present embodiment, the tabs 60 are arranged so that they project at a height which is just below the mid-point of the products 25, as this has been found to be beneficial in preventing the products from both falling over and sliding down. However, the height of the tabs can be selected as required for the particular application. Similarly, the number of pairs of tabs 60 can be selected as required for the size and type of product 25. In the present embodiment, four pairs of tabs 60 are provided along the length of the container which are used to support sixteen individually packaged products 25.

The portion 54 of the rear wall 18 which is removed with the top 24 provides a convenient window which enables a box behind the packaging container 10 on the shelf to be viewed when all the products 25 have been removed.

Figure 2:
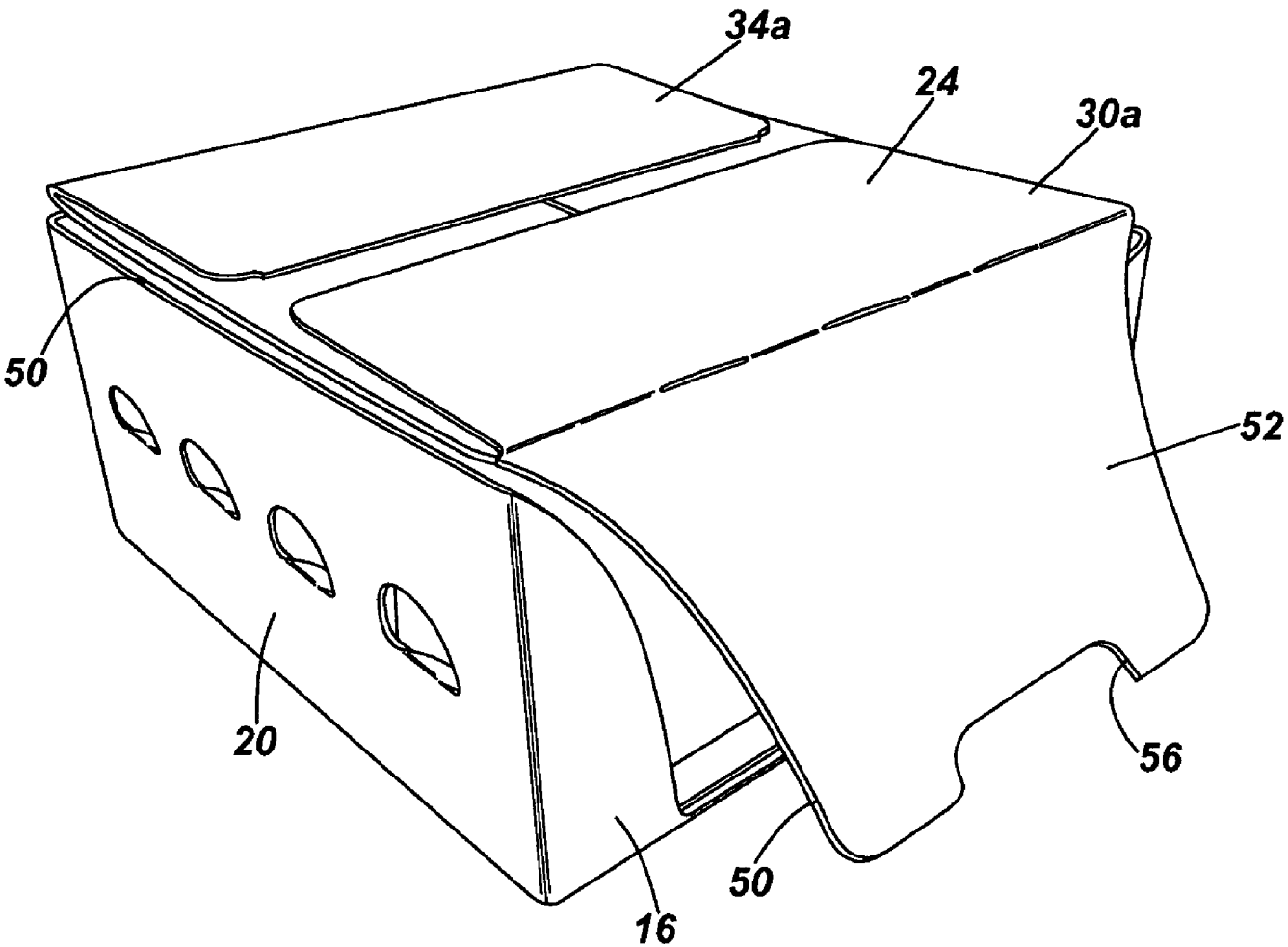
FIG. 2 is a perspective view of the packaging container of FIG. 1, illustrating how a portion of a front wall and the top closure are removed to open the container.
Figure 3:
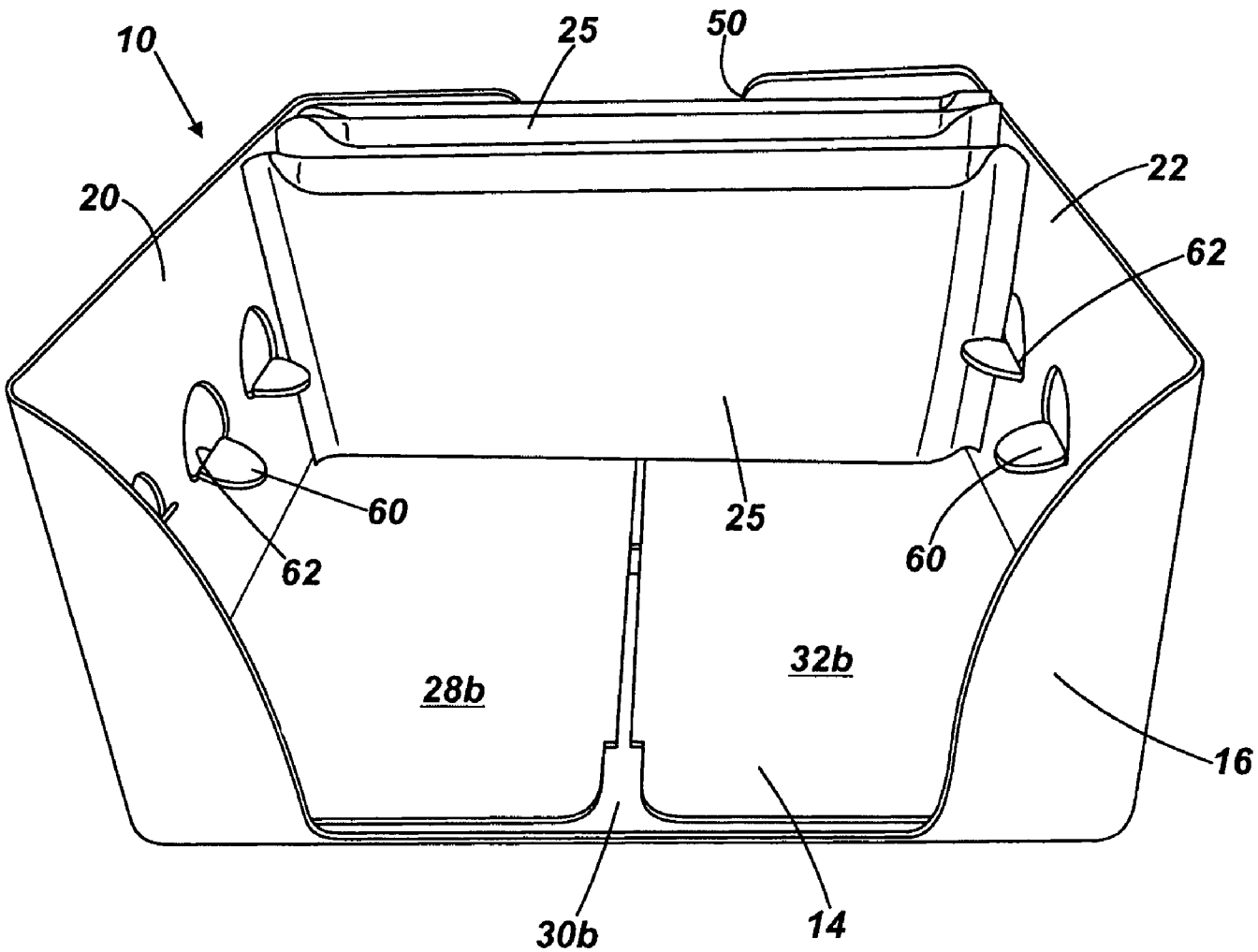
FIG. 3 is a perspective view of the packaging container of FIG. 1, with the top and portion of a front wall removed, illustrating how the side tabs hold the remaining products upright after some have been removed.
Figure 5:
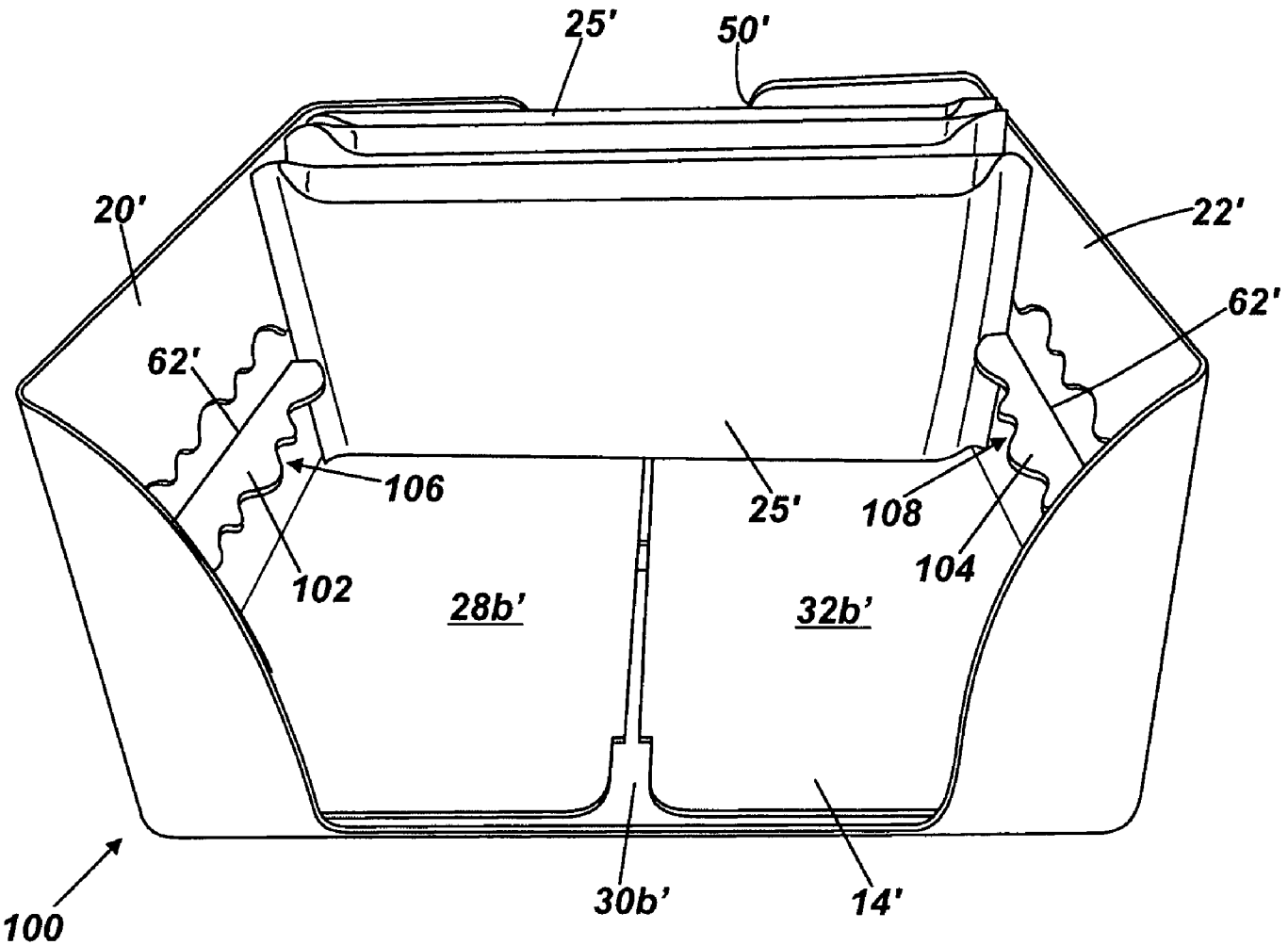
FIG. 5 is a perspective view of an alternative embodiment of a packaging container in accordance with the invention, which is similar to the packaging shown in FIG. 3.

With reference to FIG. 5, there is shown a packaging container 100 which is of a similar configuration to the packaging container 10 shown in FIGS. 1 to 3, and similar features are indicated by the same reference number prime (').  However, rather than the having a number of tabs 60, 62 located in opposing side walls, the container 100 has a single elongated tab 102, 104 formed along the panel portions which form the side walls 20', 22'. Each tab 102, 104 has undulating edges 106, 108 and the tabs are formed and function in a similar way to the tabs 60, 62. In particular, the undulating edges 106, 108 contact the sides of the individually packaged products 25'. The troughs of the undulating edges 106, 108 are capable of receiving the thin edges of the individually wrapped packaged product 25' so as to help maintain their position within the container. In a modification of this embodiment, only one single elongate tab may be provided on one of the side walls. In a further modification, the undulating edges 106, 108 can be replaced with a corrugated, castellated or toothed or "zigzagged" edge.

It can be seen that the packaging container 10, 100 in accordance with the invention is simple in design and easy to manufacture and yet provides support for the products 25, 25' to enable them to be securely displayed in an upright position and also provides added protection for the products in transit.

Packaging containers 10, 100 in accordance with the invention can be used with a wide range of products but are particularly suitable for packaging generally block shaped products, especially confectionery such as chocolate bars and the like.

Whilst in the present embodiments the packaging container 10, 100 is configured to support the products in an upright position, the container may be modified to support the products 25, 25' at an inclined position. This might be desirable where the packaging container is to be placed on a low shelf and the products need to be inclined so that they are presented at an optimum viewing angle, for example.

Furthermore, whilst the packaging container 10 in accordance with the embodiment described is in the form of a box made from a single blank of material with an integral top closure, it will be appreciated that side tabs 60 as disclosed could be incorporated into a range of different packaging containers such as boxes with a removable lids, open trays and the like.

The foregoing embodiments are not intended to limit the scope of protection afforded by the claims, but rather to describe examples as to how the invention may be put into practice.

The invention claimed is:

1. A packaging container for at least one of transporting and displaying a plurality of individually packaged products, the container comprising at least a base and side walls defining an interior volume for holding the products, in which each side wall has a length parallel to the base and at least one side wall has one or more tabs, said one or more tabs projecting into the interior volume for contact with products in the container, each tab comprising a portion of the at least one side wall which is bent inwardly out of the plane of the at least one side wall about a fold line leaving an aperture in the remainder of the at least one side wall, and, prior to bending, each tab having free edges spaced from the remainder of the at least one side wall by a cut-out in the at least one side wall such that the surface area of the tab is less than the surface area of the aperture.

2. A packaging container as claimed in claim 1, in which there are said one or more tabs on each of two opposing side walls.

3. A packaging container as claimed in claim 1, in which at least one said side wall has a plurality of said tabs spaced along its length.

4. A packaging container as claimed in claim 1, in which at least one said side wall is joined to the base along an edge and a fold line is at an acute angle with respect to at least part of the edge.

5. A packaging container as claimed in claim 4, in which the acute angle is less than about 75°.

6. A packaging container as claimed in claim 1, in which at least one said side wall is joined to the base along an edge and a fold line is substantially parallel to at least part of the edge.

7. A packaging container as claimed in claim 1, in which each tab is bent about its respective fold line through an angle of about 90° or more.

8. A packaging container as claimed in claim 1, having two opposed side walls in which the one or more tabs are arranged as opposed pairs of tabs one tab of each pair in one of the two opposed side walls.

9. A packaging container as claimed in claim 1, in which the container has front and rear walls and an integral top closure.

10. A packaging container as claimed in claim 9, in which the container has one or more lines of weakness arranged such that at least a portion of the top closure can be removed by tearing along the one or more lines of weakness.

11. A combination of a packaging container as claimed in claim 1, further including a plurality of individually packaged products within the interior volume of the container, said one or more tabs contacting end regions of the products.

12. A combination as claimed in claim 11, in which the products are confectionery products.

13. A combination as claimed in claim 12, in which the confectionery products comprise chocolate bars.

14. A method of forming a packaging container for at least one of transporting and displaying a plurality of individually packaged products, the method comprising:

a. providing a container comprising at least a base and side walls defining an interior volume for holding the products;

b. providing one or more tabs on at least one side wall, said one or more tabs being connected to the remainder of the at least one side wall by one or more fold lines and the free edges of the one or more tabs being spaced from the remainder of the at least one side wall by a cut-out; and c. bending said one or more tabs about the one or more fold lines so that the one or more tabs project into the interior volume for contact with products in the container.

15. A method as claimed in claim 14, in which the method comprises bending the one or more tabs through an angle of less than about 90°, subsequently introducing a plurality of individually packaged products into the interior volume so that the products contact the one or more tabs as they are inserted into the interior volume and further bending the one or more tabs through an angle of more than 90°.

16. A method as claimed in claim 14, the method further comprising forming the container from a single, unitary blank of material.

17. A blank for forming a packaging container as claimed in claim 1, the blank comprising a single unitary sheet of material having fold lines which define panel portions which constitute the side walls of the container when it is formed, in which said one or more tabs are provided on at least one of the side wall panel portions, the one or more tabs being connected with the remainder of their respective side wall panel portions by means of one or more fold lines about which the one or more tabs can be bent out of the plane of its respective panel portion, the free edges of the one or more tabs being spaced-from the remainder of their respective side wall panel portion by means of a cut-out.

18. A blank as claimed in claim 17, in which at least one side wall panel portion has a plurality of tabs spaced along its length.

19. A blank as claimed in claim 17, in which each tab is formed by means of a cut line in its respective side wall panel portion.

20. A blank as claimed in claim 19, in which each tab is formed by means of spaced cut-lines to define the cut-out.

21. A blank as claimed in claim 19, in which each tab is semi-circular in shape.

22. A blank as claimed in claim 21, in which each semi-circular tab is formed by means of an arcuate cut-out.

23. A blank as claimed in claim 17, the blank comprising four main panels arranged in-line with adjacent main panels being separated by a transverse fold line, each main panel being divided into three panel portions by means of spaced longitudinal fold lines; a middle one of the panel portions being configured to form a wall of the container when it is formed, a first outer one of the panel portions comprising a flap for forming the base of the container when it is formed and the other of the outer panel portions comprising a flap for forming a top closure of the container when it is formed.

24. A blank as claimed in claim 23, the blank having one of more lines of weakness configured to enable at least the flaps which form the top closure to be removed from the completed container by tearing along the one or more lines of weakness.

25. A blank as claimed in claim 24, in which a middle panel portion of one of the main panel portions constitutes a front wall of the completed container, the one or more lines of weakness extend into the middle panel portion and being configured such that a portion of the front wall of the completed container can be removed by tearing along the one or more lines of weakness.

* * * * *